US005399241A

United States Patent [19]

Oriaran et al.

[11] Patent Number: 5,399,241

[45] Date of Patent: Mar. 21, 1995

[54] SOFT STRONG TOWEL AND TISSUE PAPER

[75] Inventors: T. Philips Oriaran; Anthony O. Awofeso, both of Appleton; Thomas N. Kershaw, Neenah; Phuong V. Luu, Appleton; Cristian M. Neculescu; Michael E. Huss, both of Neenah, all of Wis.

[73] Assignee: James River Corporation of Virginia, Richmond, Va.

[21] Appl. No.: 130,408

[22] Filed: Oct. 1, 1993

[51] Int. Cl.[6] ..... D21H 21/22

[52] U.S. Cl. ..... 162/112; 162/158; 162/179; 162/184

[58] Field of Search ..... 162/158, 111, 112, 113, 162/179, 184

[56] References Cited

FOREIGN PATENT DOCUMENTS 201761 11/1986 European Pat. Off. ..... 162/158

8200485 2/1982 WIPO ..... 162/111

*Primary Examiner*—Peter Chin

[57] ABSTRACT

Disclosed is a method for producing an absorbent creped cellulosic sheet having a high level of surface-perceived softness that comprises continuously forming a web of cellulosic papermaking fibers, adhering said web to a thermal drying means, treating said adhered web with an amido amine salt derived from a partially acid-neutralized amine, and creping said treated web from said thermal drying means.

29 Claims, 2 Drawing Sheets

SOFT STRONG TOWEL AND TISSUE PAPER

This invention relates broadly to papermaking. More specifically, this invention is concerned with the manufacture, by methods that include creping, of grades of absorbent paper that are suitable for use as paper toweling, napkins, facial tissue, and bathroom tissue (toilet paper).

BACKGROUND OF THE INVENTION

In the interest of editorial simplicity, this specification will refer to "bathroom tissue". However, where the context allows, it should be understood that the relevant technological principles apply also to the manufacture of all lightweight absorbent grades of paper, including, for instance, facial tissue and paper toweling.

Paper is generally manufactured by suspending cellulosic fibers of appropriate length in an aqueous medium and then removing most of the water. The paper derives some of its structural integrity from the mechanical arrangement of the cellulosic fibers in the web, but most by far of the paper's strength is derived from hydrogen bonding which links the cellulosic fibers to one another. With paper intended for use as bathroom tissue, the degree of strength imparted by this interfiber bonding, while necessary to the utility of the product, results in a lack of perceived softness that is inimical to consumer acceptance. One common method of increasing the perceived softness of bathroom tissue is to crepe the paper. Creping is generally effected by fixing the cellulosic web to a Yankee drum thermal drying means with an adhesive/release agent combination and then scraping the web off of the Yankee by means of a doctor blade. Creping, by breaking a significant number of interfiber bonds, increases the perceived softness of resulting bathroom tissue product.

However, creping alone may not be sufficient to impart the optimum degree of softness to the bathroom tissue. Therefore, as reported for instance by Graef et alia in U.S. Pat. No. 5,225,047, by Van Phan in U.S. Pat. No. 5,217,576, and by Soerens et alia in U.S. Pat. No. 4,795,530, compounds such as quaternary amines that function as debonding agents are often incorporated into the paper web. As Soerens points out, cationic quaternary amines can be added to the initial fibrous slurry from which the paper web is subsequently made. Soerens teaches that it is preferable, however, to spray the chemical debonding agent onto the cellulosic web, after it is formed but before it is dried. Soerens indicates that a problem with cationic quaternary amines is that they substantially interfere with the adhesive/release agent combination normally employed to obtain proper adhesion of the cellulosic web precursor to the Yankee drum thermal drying means. Soerens teaches that this problem may be overcome by spraying the amines onto the partially dewatered web in such a way that the amines penetrate no more than 40% of the way through the thickness of the web. Soerens teaches that the presence of some sort of vacuum device at the point at which the amine is sprayed onto the web is essential to achieve and control the proper penetration of the debonding agent. The teachings of the Soerens patent indicate that in order to obtain soft strong bathroom tissue, the amines must not be sprayed onto the web at that stage of the papermaking process when the web is adhered to the Yankee.

Soerens refers to two earlier patents that deal with the addition of quarternary ammonium compounds to wet cellulosic webs: U.S. Pat. No. 2,756,647 and Canadian Patent No. 1,159,694. Like Soerens, the Canadian patent is concerned with the manufacture of creped bathroom tissue; this patent teaches spraying the partially dewatered web with an acidified debonding agent before adhering it to the Yankee dryer. U.S. Pat. No. 2,756,647 does not appear to be concerned with the manufacture of creped bathroom tissue. Although this patent refers to "soft paper tissue", there is no mention of creping in the patent. It is believed that this patent, which is assigned to Personal Products Corporation, is concerned with the preparation of coverstock for catamenial fluid absorbtion products. The patent teaches that aromatic quarternary ammonium bactericides may be sprayed onto paper backed by (but apparently not adhered to) what appears to be a small drum dryer. There does not appear to be any adhesive/release agent involved, as there would be in a creping context. Because there is substantial opportunity for undesirable interaction between softener compounds and release agents in the papermaking process, it is believed that the teachings of U.S. Pat. No. 2,756,647 are largely irrelevant to the present invention which does relate to creping with its concomitant adhesives and release agents.

U.S. Pat. No. 4,447,294 to Osborn discloses another way to avoid problems on the Yankee stemming from the use of quaternaries. Osborn applies the quaternaries to the product after it is creped from the Yankee.

The Soerens patent alleges that, in order to obtain the result indicated by the patent to be its objective, careful control of the amount of debonder solution applied—as well as of the vacuum applied to the wet web after the debonder solution is sprayed on it—is required.

It is an object of the present invention to provide a method for the manufacture of soft strong bathroom tissue that is simpler and more flexible that the method taught in the Soerens patent.

Spraying the web before adhering it to the Yankee dryer can result in the presence of debonder in the "white water" that is generally recirculated as carrier into the papermaking process. The debonder, which is cationic, is thought to interact with "trash" in the water, such as "fines"—that is, tiny bits of broken cellulose fibers—and oily or gummy substances—derived from the pulp—to form deposits that reduce tensile strength in the paper being produced and increase problems with runnability of the process.

It is also an object of this invention, therefore, to provide a method for the manufacture of bathroom tissue that avoids the problems that sometimes occur when softener is recirculated directly into the papermaking process.

One-ply bathroom tissue generally suffers from the problem of "sidedness"—that is, one side of the sheet is generally appreciably less soft than the other side. Sidedness is introduced into the sheet during the manufacturing process. In some cases, the sidedness is introduced intentionally, by means of a two-slice headbox. In such cases, one slice provides softwood fibers for strength and the other slice provides hardwood fibers for softness. The resulting sheet is stratified, with the softwood side being dramatically rougher than the hardwood side. Such paper is suitable for use in making two-ply products, in which the two rougher sides face each other and the two softer sides face outwardly. A more sophisticated procedure, described for example in U.S. Pat. No. 5,178,729 (Janda—incorporated herein by reference) involves the use of a three-slice headbox, in which the middle slice provides a layer with strength and, if desired, bulk characteristics, and the two outer slices provide soft hardwood layers. Even with three-layered laminated sheets, however, sidedness can be a problem, being imparted to the sheet during the drying procedure. The side of the sheet that was adhered to the Yankee and creped off is generally softer than the "air" side of the sheet. This two-sidedness is seen both in sheets that have been pressed to remove water and in unpressed sheets that have been subjected to vacuum and hot air (through-drying) prior to being adhered to the crepe dryer.

It is a further object of this invention to provide a method for the manufacture of one-ply bathroom tissue that shows a relatively low degree of "sidedness".

SUMMARY OF THE INVENTION

Applicant has unexpectedly discovered that a certain class of chemical compounds can be applied to the air sides of papermaking webs while such webs are adhered to heated Yankee drying drums without interfering with the adhesion and release (creping) operations to which such webs are subjected, and that said compounds can be used to soften said air sides in such a manner that the resulting sheets of bathroom tissue are strong enough to be serviceable yet are soft on both sides.

Practice of the process aspect of the present invention provides an absorbent creped paper sheet having a basis weight of from about 7.5 pounds per ream to about 30 pounds per ream and comprising cellulosic papermaking fibers, wherein at least one surface of said sheet has distributed thereupon an amido amine salt derived from a partially acidneutralized amine, said salt being distributed substantially uniformly over the entire said surface of said sheet. Said sheet may comprise a homogeneous mixture of hardwood papermaking fibers and softwood papermaking fibers, or it may constitute a nonlaminated stratified sheet having two surfaces comprised predominately of hardwood papermaking fibers and a central stratum comprised predominately of softwood papermaking fibers.

By "distributed substantially uniformly over the entire said surface of said sheet" is meant that the softener shows a surface distribution within each tactilly perceptible square unit area that differs from any other such unit area by less than some relatively small ratio, such as 15%. For instance, softener concentration for a given square centimeter of the sheet would not differ from softener concentration for any other square centimeter of the sheet by more than 15%. This uniformity is important because research tends to indicate that a sheet in which there is noticeable variation from place to place in surface softness is generally perceived as rougher than a sheet with more uniform softness even where the physically measurable average softness of the uniform sheet is somewhat lower than that of the variable softness sheet.

DETAILED DESCRIPTION OF THE INVENTION

In accordance with the present invention, a method is provided for producing a highly absorbent, predominantly cellulosic sheet that exhibits excellent overall quality and a high degree of surface-perceived softness. The present invention has utility in a wide variety of papermaking processes, including foam-forming, conventional pressed, and through-dried processes. For the sake of simplicity, however, the invention will be described immediately hereinbelow in the context of a conventional dry crepe wet-forming process. A schematic drawing depicting a process configuration is set forth in FIG. 1.

In the method of the present invention, an aqueous furnish including cellulose papermaking fibers is initially formed. The cellulosic fibers have undergone some degree of lignin modification, such as at least partial chemical treatment, to produce materials such as chemimechanical pulp, semichemical pulp, chemical pulp, or mixtures thereof. Suitable materials from which the cellulose fibers can be derived include the usual species of coniferous and deciduous pulpwood. A minor amount of special purpose natural or synthetic fibers may also be included in the furnish if desired.

The aqueous furnish is transported to a headbox 10 at a concentration level sufficient to permit the formation of a substantially dry sheet upon completion of the hereinafter described dewatering and thermal-drying steps, without requiring further drying thereof subsequent to creping. The headbox 10 can be any type suitable for conventional wet-forming or foam-forming. Multi-layer headboxes are often used in the preparation of bathroom tissue, with three or four layer headboxes being particularly useful in the preparation of one-ply bathroom tissue. A conventional pulp refiner system may also be present upstream of the headbox. The addition of dry strength chemicals and refining are conventional procedures for adding strength back to paper when debonders or other chemical agents that tend to decrease strength are being used. As a practical matter, the consistency of the aqueous furnish used in forming the subject wet web is desirably maintained at a level of from about 0.05% by weight up to about 1.0% by weight, and more preferably from about 0.1% by weight up to about 0.75% by weight, based on the total weight of cellulosic papermaking fibers in the aqueous furnish.

A wet web 11 is then formed by deposition of the aqueous furnish onto a web forming means 12, typically a conventional papermaking system including a foraminous conveying means such as a Fourdrinier wire or the like.

Figure 1:
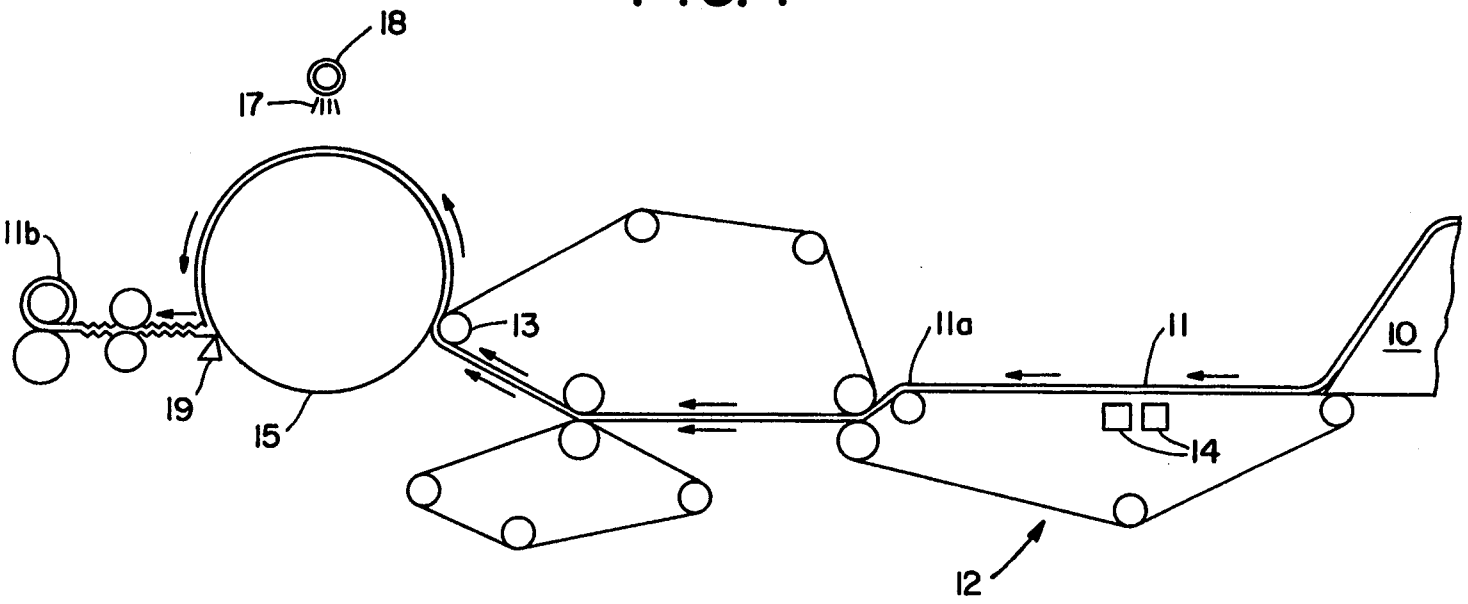
FIG. 1 is a schematic representaion of the overall papermaking process in accordance with the present invention.

Dewatering of the wet web is then provided prior to the thermal drying operation, typically by employing a nonthermal dewatering means 14. The nonthermal dewatering step is usually accomplished by various means for imparting mechanical compaction to the web 11, such as vacuum boxes, slot boxes, coacting press rolls, or combinations thereof. For purposes of illustration of the method of this invention, the wet web 11 is dewatered by subjecting same to a series of vacuum boxes and/or slot boxes, as shown in FIG. 1. Thereafter, the web is further dewatered by subjecting same to the compressive forces exerted by nonthermal dewatering means such as, for example, a pair of rollers, followed by a pressure roll coacting with a thermal drying means.

The wet web 11 is carried by the foraminous conveying means 12 through the nonthermal dewatering means 14, where it is dewatered to a fiber consistency of at least about 5% up to about 50%, preferably at least 15% up to about 45%, and more preferably to a fiber consistency of approximately 40%. The cellulosic web formed, as described above, preferably has an initial pH of at least about 5 in order to minimize corrosion problems that can occur with respect to the foraminous conveying means as well as to other portions of the papermaking equipment if the pH is too low.

The dewatered web 11*a* is applied to the surface 15 of thermal drying means 16, preferably a thermal drying cylinder such as a Yankee drying cylinder, employing preferably an adhesive to supplement the adhesion process. Examples of typical adhesive compounds that may be used include carboxymethyl cellulose, polyvinyl alcohol, anionic starch, various soluble natural polymers such as gums and the like, and synthetic resins such as polyaminoamideepichlorohydrin and glyoxylated cationic polyacrylamides, and the like. Adhesion of the dewatered web 11*a* to the cylinder surface 15 is preferably facilitated by the mechanical compressive action exerted thereon, generally using one or more press rolls 13, which form a nip in combination with thermal drying means 16 and which brings the web into more uniform contact with the thermal drying surface 15.

Under the definition of "Yankee" is included all large cast-iron drying cylinders on which towel, tissue, wadding, and machine-glazed papers are among the grades produced. Diameters typically range from 10–20 feet and widths can approach 300 inches. A typical diameter for a Yankee drying drum is 12 feet. Speeds in excess of 6000 ft/min at weights greater than 380,000 pounds are not uncommon. Dryers typically incorporate a center shaft and are supported on journals by two large antifriction bearings. Steam, up to 160 psig (Code limitation for cast-iron unfired pressure vessels) is supplied through the front-side journal and exhausted, along with condensate, through the back-side journal. A typical steam pressure is 125 psig. Pressure rolls, one or two usually loaded between 200 and 500 pounds/lineal inch, are employed to press the sheet uniformly against the shell face. The sheet is removed from the dryer several quadrants away, having been imparted with properties characteristic of the desired paper product. This definition does not include smaller cast-iron paper dryers, even though many similarities exist.

The dewatered wet web 11*a* after it is adhered to the Yankee dryer is treated with a softener material 17. By treating the web 11*a* in this manner, a creped sheet 11*b* having the hereinafter defined unexpected properties can be produced.

A crucial feature of the present invention is the use of a particular class of softener materials—amido amine salts derived from partially acid neutralized amines. Such materials are referred to in U.S. Pat. No. 4,720,383; column 3, lines 40–41. Also relevant are the following articles: Evans, *Chemistry and Industry, Jul.* 5, 1969, pp. 893–903; Egan, *J. Am. Oil Chemists' Soc.*, Vol. 55 (1978), pp. 118–121,; and Trivedi et al., J. Am. Oil Chemists' Soc., June 1981, pp. 754–756. Egan, for example, describes the diacylation of diethylene triamine to provide a secondary amine which is then alkoxylated with ethylene or propylene oxide to provide a class of compounds that can be used to prepare amido amine salts that are useful in accordance with the present invention:

$$2RCOOH + H_2NCH_2CH_2NHCH_2CH_2NH_2 \rightarrow RCONHCH_2CH_2NHCH_2CH_2NHCOR$$

$$RCONHCH_2CH_2NHCH_2CH_2NHCOR + nCH_2\text{—}CH_2 \xrightarrow{} RCONHCH_2CH_2N(CH_2CH_2O)_nHCH_2CH_2NHCOR$$

All of the above publications are incorporated herein by reference. As indicated therein, softeners are often available commercially only as complex mixtures, often containing among other things cyclic species such as imidazolines, rather than as single compounds. While this discussion will focus on the predominate species, it should be understood that commercially available mixtures would generally be used in practice.

The softener material that is currently most preferred is referred to hereinafter as Q-202. This most preferred softener material is derived by alkylating a condensation product of oleic acid and diethylenetriamine. Synthesis conditions using a deficiency of alkylating agent (e.g., diethyl sulfate) and only one alkylating step, followed by pH adjustment to protonate the non-ethylated species, result in a mixture consisting of cationic ethylated and cationic non-ethylated species. A minor proportion (e.g. about 10%) of the resulting amido amines lose water and cyclize to imidazoline compounds. Such materials may be obtained from Quaker Chemical Corporation. Since these materials are not quarternary ammonium compounds, they are pH-sensitive. Therefore, in the practice of the present invention with this class of chemicals, the pH of the web being treated should not go above 7, and will preferably be somewhat below 6.5.

The primary active ingredients in these softener materials may be described as salts of the formula $$[(RCO)_2EDA]HX$$

wherein EDA is a residue of diethylenetriamine, R is the residue of a fatty acid having from 12 to 22 carbon atoms, and X is any anion that does not interfere with the process of the invention. A more precise formula is believed to be $$[(RCONHCH_2CH_2)_2NR']HX$$

wherein R and X are as described above and R' is a lower alkyl group. Currently most preferred are compounds of the formula $$[(C_{17}H_{33}CONHCH_2CH_2)_2NC_2H_5]HSO_4C_2H_5$$

The softener 17 employed for treatment of the web is provided at a treatment level that is sufficient to impart a perceptible degree of softness to the web but less than an amount that would cause significant runnability and sheet strength problems in the final commercial product. The amount of softener 17 employed, on a 100% active basis, is preferably from about 0.5 pounds per ton of cellulose pulp up to about 15 pounds per ton of cellulose pulp. More preferred is from about 3 to about 7 pounds per ton.

Treatment of the wet web with the softener can be accomplished by various means. For instance, the treatment step can comprise spraying, applying with a direct contact applicator means, or by employing an applicator felt. The preferred method of application is by spraying the web such as by employing spray header 18 at various points on thermal drying means 16 (see FIG. 1). For more detail, see the discussion of FIG. 2 hereinbelow.

The web is then dried on the thermal drying surface, preferably to a consistency of at least about 92%, and more preferably to a consistency of about 95%. The creping means 19 then removes the dried, creped sheet 11*b* from the thermal drying surface, the creping action disrupting bonds between respective fibers and causing a softening effect to be imparted to the sheet. In general, the creping means is a doctor blade that crepes and removes the sheet from the thermal drying surface.

An important aspect of this invention is the ability of the subject method to produce sheets in an extremely broad basis weight range. The basis weight of the sheet produced by the subject method can range from about 5 pounds per ream (3000 square feet) up to about 50 pounds per ream, preferably from about 7.5 pounds per ream up to about 30 pounds per ream, and most preferably from about 15 pounds per ream up to about 25 pounds per ream.

Figure 2:
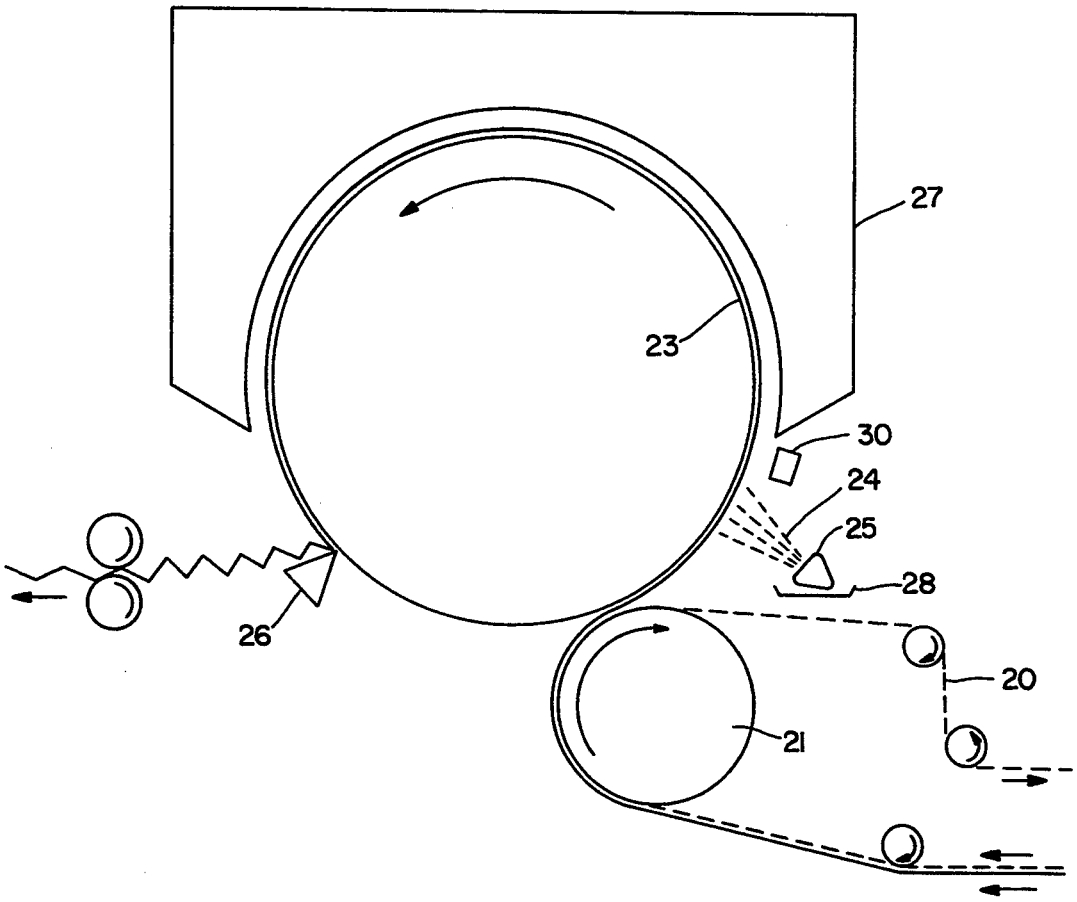
FIG. 2 is a schematic representation of the spraying environment in accordance with the present invention.

FIG. 2 shows a mechanism for incorporating softener into bathroom tissue in accordance with the present invention.

The wet web, which has been dewatered to the point where from 50 to 85% moisture, preferably from 60 to 75% moisture, remains therein, is carried by the felt 20 resting on rolls such as suction press roll 21. The softener is applied to this partially moist web at this stage by intensive spray just before the final drying step on the Yankee dryer drum 23.

In accordance with the present invention, softener material is pumped into a mixing tank wherein it is combined with the correct proportion of water by means of metering pumps. For a typical operation, the percentage of softener in the water in the mixing tank may vary from 0.5% to about 10% by weight. Most of the softener compounds according to the present invention mix fairly easily with water, although special prolonged agitation may be necessary under certain circumstances.

From the mixing tank the aqueous solution may be passed through a spray pump into a filter for removal of any impurities. This filter may be of the full or continuous flow type. After the filter, the solution goes into a feed tank, and from the feed tank into the spray head.

The spray head applies the solution, generally in the form of a very fine mist, to the partially dried formed tissue. Material that is not absorbed by the tissue may be caught within a catch pan and is recovered into a recovery tank from which it returns through a filter into the mixing tank. If sufficient control is exercised over the amount of active solution sprayed onto the web adhered to the Yankee, there will be no significant runoff and a catch pan may not be necessary.

In accordance with preferred embodiments of the invention, the solution is applied to the paper through the spray 24 of the spray head 25 upwardly against a large Yankee drier 23. A typical temperature for the surface of the Yankee is 200° F. The Yankee drier 23 is generally partially covered by a hood 27. Downward escape of unused solution may be prevented by an optional catch pan 28 with a drain leading to a recovery tank. In some embodiments of this invention a suction pump may be provided with the hood so as to discourage escape of the solution. The suction outlet pulls the vaporized solution away from the hot drier surface to speed its condensation in a cooler area.

Each spray head 25 has a substantial number of nozzles. Thirty to sixty nozzles may be used conventionally and two or more banks of nozzles may be used if desired. Contacting the paper in this manner, the solution is well distributed throughout the paper and is easily absorbed because of the moist condition of the paper and because of its elevated temperature as it is then undergoing the drying process. Typical temperatures of the paper at this spot are 160°–180° F. This is in sharp contrast to the teachings of Soerens, who emphasizes that his quarternary ammonium compounds must not be allowed to penetrate even halfway through the thickness of the tissue. The speed of the paper going past the spray head may be from a few hundred to several thousand feet per minute. Machines speeds of 2000–3000 feet per minute are commonly used. These conditions may be varied for various machines, processes, and special circumstances. A typical residence time for the web on the dryer surface is from 0.9 to 1.3 seconds.

The hood 27 and the catch pan 28 collect a very high percentage of the unused solution and prevent any escape of the unused solution into the white water or any other part of the paper machine. The drain of the catch pan returns unused material through the recovery tank and the filter into the mixing tank from whence it returns to the spray head through the system described above. This final step including the two filters eliminates fibrous impurities from the solution and acts to avoid frequent blocking of the fine orifices of the nozzles.

An optional infrared dryer 30 or other means of supplemental drying may be positioned near the Yankee after the spraying station in order to promote rapid drying. However, if sufficient control is exercised over the amount of active solution sprayed onto the web adhered to the Yankee, this predrying operation may not be necessary. After the tissue has been subjected to the drying effect of the Yankee, it is creped off by a creping doctor blade 26.

Tensile Strength and Softness

Tensile strength of tissue produced in accordance with the present invention is measured in the machine direction and cross-machine direction on an Instron tensile tester with the gauge length set to 4 inches. The area of tissue tested is assumed to be 3 inches wide by 4 inches long. In practice, the length of the samples is the distance between lines of perforation in the case of machine direction tensile strength and the width of the samples is the width of the roll in the case of cross-machine direction tensile strength. A 20 pound load cell with heavyweight grips applied to the total width of the sample is employed. The maximum load is recorded for each direction. The results are reported in units of "grams/3-inch"; a more complete rendering of the units would be "grams per 3-inch by 4-inch strip".

Softness is a quality that does not lend itself to easy quantification. J.D. Bates, in "Softness Index: Fact or Mirage?", TAPPI, Vol. 48 (1965), No. 4, pp. 63A–64A, indicates that the two most important readily quantifiable properties for predicting perceived softness are (a) roughness and (b) what may be referred to as stiffness modulus. Tissue and toweling produced according to the present invention have a more pleasing texture as measured by reduced values of either or both roughness or stiffness modulus (relative to control samples). Surface roughness can be evaluated by measuring geometric mean deviation in the coefficient of friction using a Kawabata KES-SE Friction Tester equipped with a fingerprint-type sensing unit using the low sensitivity range. A 25 g stylus weight is used, and the instrument readout is divided by 20 to obtain the mean deviation in the coefficient of friction. The geometric mean deviation in the coefficient of friction is then the square root of the product of the deviation in the machine direction and the cross-machine direction. The stiffness modulus is determined by the procedure for measuring tensile strength described above, except that a sample width of 1 inch is used and the modulus recorded is the geometric mean of the ratio of 50 grams load over percent strain obtained from the load-strain curve. All stiffness moduli referred to herein should be understood to be normalized to a basis weight of 15 lbs/ream, with the dimensions being expressed as g @50 g/in, % strain being dimensionless.

EXAMPLES

Heavyweight One-ply Tissue

Stratified one-ply tissue was manufactured according to the present invention to a target basis weight of 22 lbs/ream (35.8 gr/sq meter). The tissue was made utilizing a three-layer headbox, generally in accordance with the methods taught in the Janda patent cited above. Each of the two outer layers of the tissue sheeting constituted approximately 25% of the thickness of the sheet and was comprised predominately of Burgess hardwood kraft fibers; the center layer was comprised predominately of equal parts of softwood kraft fibers and bulking fibers sold by Weyerhaeuser Company as "HBA". HBA is a bleached kraft pulp which is chemically and mechanically modified to make it suitable for bulking in wetlaid paper applications. Its Kajaani weighted average fiber length is about 2.7 mm while the coarseness is about 34 mg per 100M. HBA fiber is believed to be somewhat similar to fiber described in U.S. Pat. No. 4,853,086. The papermaking machine configuration was that type referred to as a "crescent former". It was run using the foam-forming technology disclosed in the Janda patent at a speed of 1800 ft/min. The creping adhesive agent used was of the epichlorohydrin-polyaminoamide type. A 20% crepe was achieved using a 15 degree beveled creping blade.

Table 1 presents physical data on two products prepared in accordance with the present invention. Both Examples 1 and 2 refer to tissue sheeting onto which was sprayed Q-202 at the rate of 5 pounds per ton. Example A is an unsprayed control. Example B is an unsprayed control to which Q-202 at the rate of 5 pounds per ton was added in the stuffbox. The table shows basis weight in pounds per ream (3000 square feet), dry tensile strength measurements—in grams per 3 inch—for Machine Direction and Cross-machine Direction, stiffness in grams per % stretch, and friction (which is dimensionless). As Table 1 demonstrates, spraying Q-202 onto the tissue sheeting in accordance with the present invention dramatically improves perceived softness (as indicated by the reduction in Stiffness and Friction numbers).

TABLE 1

| Ex. # | Basis Wt lbs/ream | MD Tens. gm/3 inch | CD Tens. gm/3 inch | Stiffness gm/% stretch | Frict. |
|---|---|---|---|---|---|
| A | 22.9 | 1709 | 932 | 42.1 | 0.234 |
| 1 | 20.7 | 1321 | 751 | 37.0 | 0.210 |
| 2 | 22.0 | 1191 | 647 | 32.1 | 0.238 |
| B | 21.6 | 1554 | 777 | 46.8 | 0.249 |

Lightweight One-ply Tissue

Stratified one-ply tissue was manufactured according to the present invention to a target basis weight of 17 lbs/ream. The tissue was made utilizing a three-layer headbox, generally in accordance with the methods taught in the Janda patent cited above. Each of the two outer layers of the tissue sheeting constituted approximately 30% of the thickness of the sheet and was comprised predominately of Burgess hardwood kraft fibers; the center layer was comprised predominately of $\frac{5}{8}$ parts softwood kraft fibers and $\frac{3}{8}$ parts bulking fibers sold by Weyerhaeuser Company as "HBA". HBA is a bleached kraft pulp which is chemically and mechanically modified to make it suitable for bulking in wetlaid paper applications. Its Kajaani weighted average fiber length is about 2.7 mm while the coarseness is about 34 mg per 100M. HBA fiber is believed to be somewhat similar to fiber described in U.S. Pat. No. 4,853,086. The papermaking machine configuration was that type referred to as a "crescent former". It was run using the foam-forming technology disclosed in the Janda patent at a speed of 1800 ft/min. The creping adhesive agent used was of the polyaminoamide-epichlorohydrin type. A 20% crepe was achieved using a 15 degree beveled creping blade.

Table 2 presents physical data on two products prepared in accordance with the present invention. Both Examples 3 and 4 refer to tissue sheeting onto which was sprayed Q-202 at the rate of 5 pounds per ton. Examples K and L are unsprayed controls. The data are presented in order of Tensile Strength. As a general rule, friction measurements tend to increase and perceived softness tends to decrease as tissue strength increases. The table shows basis weight in pounds per ream (3000 square feet), dry tensile strength measurements—in grams per 3 inch—for Machine Direction and Cross-machine Direction, composite tensile strength (accompanied by Refiner Amps used to obtain the product), stiffness in grams per % stretch, and friction (which is dimensionless). Friction numbers have been obtained for both the Yankee Side and the Air Side of the tissue sheeting. We have noted that small changes in physical properties often result in large changes in perceived softness. Table 2 indicates that spraying Q-202 onto the tissue sheeting in accordance with the present invention tends to improve perceived softness, as indicated by the Air Side Friction numbers.

TABLE 2

| Ex. # | lbs/ream | MD | CD | Tens. (amps) | Stiff. | Fric. AIR | Fric. YANK |
|---|---|---|---|---|---|---|---|
| K | 16.1 | 628 | 282 | 421 (43) | 11.4 | 0.183 | 0.166 |
| 3 | 17.2 | 647 | 287 | 431 (48) | 12.8 | 0.179 | 0.160 |
| L | 16.7 | 705 | 331 | 483 (45) | 13.1 | 0.205 | 0.183 |
| 4 | 16.0 | 731 | 332 | 493 (54) | 12.9 | 0.195 | 0.176 |

Conventional Water-Formed Tissue

Unstratified homogeneous fiber mix one-ply tissue was manufactured according to the present invention to a target basis weight of 16 pounds per ream. The tissue was made utilizing a one-layer headbox in accordance with standard low-speed wet processing techniques. The furnish consisted of 50% Burgess hardwood kraft fibers and 50% Marathon softwood kraft fibers. The papermaking machine was run at a speed of 100 ft/min. The creping adhesive agents used were of the polyaminoamide-epichlorohydrin type in the cases of Examples P, Q, 5, and 6, and were glyoxalated cationic polyacrylamides in the cases of Examples R and 7. An 8 degree beveled creping blade was used. An 18% crepe was maintained.

Table 3 presents physical data on two products prepared in accordance with the present invention. Examples 5, 6, and 7 refer to tissue sheeting onto which was sprayed Q-202 at the rate of 1 pound per ton. Examples P, Q, and R are controls onto which no softener solution was sprayed. The table shows basis weight in pounds per ream (3000 square feet), dry tensile strength measurements—in grams per 3 inch—for Machine Direction and Cross-machine Direction, stiffness in grams per % stretch, and friction (which is dimensionless). As the data in Table 3 demonstrates, spraying Q-202 onto the tissue sheeting in accordance with the present invention dramatically improves perceived softness (as indicated by the reduction in Stiffness and Friction numbers).

TABLE 3

| Ex. # | Basis Wt lbs/ream | MD Tens gm/3 inch | CD Tens. gm/3 inch | Stiffness gm/% stretch | Frict. |
|---|---|---|---|---|---|
| P | 15.1 | 2086 | 656 | 40.0 | 0.277 |
| Q | 15.6 | 1884 | 615 | 36.0 | 0.253 |
| R | 16.2 | 2236 | 623 | 37.9 | 0.292 |
| 5 | 14.9 | 2732 | 756 | 24.4 | 0.220 |
| 6 | 15.7 | 2262 | 666 | 29.0 | 0.225 |
| 7 | 15.6 | 2433 | 614 | 35.5 | 0.226 |

Comparison with Quaternary Ammonium Compounds

In order to demonstrate the effect of the amido amine salts that are used in accordance with the present invention on the strength of tissue as compared to the effect of various commonly-used standard quarternary amine debonders, handsheets consisting of 65% Burgess hardwood kraft and 35% Marathon softwood kraft were prepared in accordance with TAPPI Standard T205. In each case (except for the control), 0.3% of the specified debonder/softener was added to the pulp mixture, and the resulting handsheet was tested in order to determine the % change in dry tensile strength as a result of the presence of the specified debonder/softener in the product. The target basis weight of the handsheets was 12.0 pounds per ream. In each case, the actual dry tensile strength was "normalized" to the 12.0 lbs/ream target, and the normalized result for each of the debonder/softener-containing products was compared to that for the control. The results are given in Table 4.

TABLE 4

| Ex. # | Additive | Basis Wt. lbs/ream | Dry Tens. gm/l | Norm. Dry Tens. | % Change Dry Tens |
|---|---|---|---|---|---|
| V | none | 11.8 | 849 | 866 | 0.0 |
| W | Q-202 | 11.8 | 798 | 812 | −6.2 |
| X | Quasoft-205 | 11.4 | 631 | 664 | −23.3 |
| Y | Quasoft-206 | 11.7 | 615 | 631 | −27.1 |

TABLE 4-continued

| Ex. # | Additive | Basis Wt. lbs/ream | Dry Tens. gm/l | Norm. Dry Tens. | % Change Dry Tens |
|---|---|---|---|---|---|
| Z | DB-170 | 11.9 | 625 | 630 | −27.3 |

Q-202 is an amido amine salt that is suitable for use according to the present invention, and more particularly is that entity described hereinabove as currently most preferred. Quasoft-205 is believed to be a quaternary ammonium compound. Quasoft-206 is a mixture of fatty quaternary ammonium salts and has a cationic charge. DB-170 is an alkoxy fatty diamide quaternary amine based on diethylenetriamine. Each of the Quasoft products is available from Quaker Chemical Company. DB-170 is available from Reilly-Whiteman. The data presented in Table 4 demonstrates that compounds taught to be useful in accordance with the present invention have significantly less negative effect on the strength of tissue products that incorporate them throughout the web than do conventional quaternary ammonium salt debonder/softeners.

Uniformity of Penetration

In order to determine the depth and relative strength of penetration of tissue produced in accordance with the present invention, the following testing was conducted. Tissue was prepared by a foam-forming process, and a portion of the batch was sprayed with 5 pounds per ton of Q-202 in accordance with the present invention. Tissue samples were split in two by applying adhesive tape to both surfaces and pulling apart the taped samples. The half-sheets so produced were then taped on the tissue side and the taped samples were pulled apart, generating four specimens for each tissue sample. The first specimen (S-1) is the approximately 25% of the tissue sample that was next to the Yankee; S-2 and S-3 were the next two 25% portions of the tissue sample; and S-4 was the 25% of the tissue sample that was furthest away from the Yankee during the drying process (the "air side"). S-4, therefore, was the side of the tissue sample that was first contacted by the softener when it was applied according to the present invention. XPS nitrogen determinations were carried out on each of the specimens.

XPS is an essentially non-destructive technique that can be used to determine the composition of the outermost atomic layers of a solid material. Both elemental identification and chemical speciation are possible with careful analysis of the obtained binding energy information. XPS is accomplished by flooding the specimen with X-rays of a known energy. Absorption of these X-rays by the specimen causes photoelectrons to be emitted. The kinetic energy of the emitted photoelectrons is measured with an electron spectrometer. Binding energy is determined by subtracting the measured kinetic energy of the emitted photoelectron from the energy of the X-rays being used. The binding energy associated with a peak is then used to establish it's elemental identity and chemical state. The incoming X-rays penetrate microns into the surface of the specimen. However, the emitted photoelectrons because of their low kinetic energy can only travel a short distance without being scattered by colliding or interacting with other atoms and losing energy. This short distance ranges from 5 to 50 Angstroms, depending upon the kinetic energy of the photoelectron. Photoelectrons that are close enough to the surface to escape without loss of energy will be detected as photoelectron peaks.

Those photoelectrons that lose energy before leaving the specimen will add to the background of the spectra. This escape depth limitation makes XPS a surface analysis technique with an average depth of analysis of approximately 30 Angstroms. Quantification is possible with the use of elemental sensitivity factors to compensate for the transmission function of the spectrometer used (a Perkin Elmer Model 5600 XPS spectrometer) and the change in photo-ionization cross-sections from element to element. These sensitivity factors have been determined empirically and found to be in agreement with the current theoretical models for quantification of XPS data.

Nitrogen content was used as a surrogate for the content of amido amine salt softener. The atomic weight percent nitrogen found in each of the specimens is listed in Table 5.

TABLE 5

| Ex. # | S-1 | S-2 | S-3 | S-4 | Sheet Av'rge | Std. Dev. |
|---|---|---|---|---|---|---|
| F | 0.12 | 0.17 | 0.20 | 0.08 | 0.14 | .005 |
| G | 0.16 | 0.18 | 0.06 | 0.11 | 0.13 | .005 |
| Av'rge | 0.14 | 0.17 | 0.13 | 0.10 | 0.13 | — |
| Std. Dev. | .03 | .01 | .01 | .10 | — | — |
| 8 | 0.52 | 0.55 | 0.71 | 0.61 | 0.60 | .08 |
| 9 | 0.46 | 0.47 | 0.60 | 0.64 | 0.54 | .09 |
| 10 | 0.46 | 0.68 | 0.58 | 0.70 | 0.61 | .11 |
| Av'rge | 0.48 | 0.57 | 0.63 | 0.65 | 0.58 | — |
| Std. Dev. | .03 | .11 | .07 | .05 | — | — |

The data presented in Table 5 demonstrate that softener compounds used according to the present invention, when applied in the manner described hereinabove, permeate the entire thickness of the tissue sheeting to which they are applied and are distributed in significant concentrations throughout each layer making up said thickness. Softener compounds that are applied in accordance with the present invention are not limited in their presence or effect to layers S-1 and S-2.

Uniformity of Surface Softener

In order to determine the uniformity of distribution of softener on the surface of tissue, some of the data reported above in Table 5 were analyzed from a different point of view.

TABLE 5A

| Ex. # | S-1 | Ex. # | S-4 |
|---|---|---|---|
| G.1 | 0.16 | G.4 | 0.11 |
| G.1 - 15% | 0.136 | G.4 - 15% | 0.0935 |
| F.1 | 0.12 | F.4 | 0.08 |
| 8.1 | 0.52 | 10.4 | 0.70 |
| 8.1 - 15% | 0.442 | 10.4 - 15% | 0.59 |
| 9.1 | 0.46 | 8.4 | 0.61 |

The data presented in Table 5A were derived as follows: For each of the surface layers S-1 and S-4 analyzed for softener content in Table 5, the highest individual reading was selected in each of the two categories—control (F, G) and invention (8, 9, 10). Then, the theoretical reading that would characterize 15% less softener content was calculated. Finally, the lower (in the case of the control examples) or lowest (in the case of the invention examples) actual reading was compared to the 15% surface softener variance level. As can be seen in Table 5A, in the case of the control examples, the actual readings varied by more than 15%, while in the case of the inventive examples, the actual readings varied by less than 15%. This tends to establish that the practice of the present invention provides a sheet in which the surface softener content is not characterized by wide variability. Tissue prepared according to the present invention, therefore, would be expected to be characterized by a relatively good overall tactile softness perception.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for producing an absorbent cellulosic sheet having a high level of surface-perceived softness that comprises continuously;

a. preparing an aqueous dispersion of cellulosic papermaking fibers, b. forming a web of said cellulosic papermaking fibers substantially free of softener induced deposits, c. adhereing said web to a thermal drying means, d. treating said adhered web with a softener comprising an amido amine salt having the formula:

$$[(RCO)_2EDA]HX$$

wherein EDA is a diethylenetriamine residue, R is the residue of a fatty acid having from 12 to 22 carbon atoms, and X is an anion wherein the treatment with the amido amine salt is conducted in such a manner that the aqueous phase used in web formation step a) is not contaminated by the amine salt from treatment step d), and e. creping said treated web from said thermal drying means.

2. A method as in claim 1 wherein said aqueous dispersion of cellulosic papermaking fibers as formed in step a) contains sufficient surfactant to cause substantial foaming during said formation step b).

3. A method as in claim 1 wherein said aqueous dispersion of cellulosic papermaking fibers is subtantially free of surfactant.

4. A method as in claim 1, wherein said salt has the formula $$[(RCONHCH_2CH_2)_2NR']HX$$

wherein R is the residue of a fatty acid having from 12 to 22 carbon atoms, R' is a lower alkyl group, and X is an anion.

5. A method as in claim 1, wherein said salt has the formula $$[(C_{17}H_{33}CONHCH_2CH_2)_2NC_2H_5]HSO_4C_2H_5$$

6. A method as in claim 1 wherein the treatment of said web with said salt results in said salt being distributed substantially equally throughout the entire thickness of said web.

7. The product of the process of claim 1.

8. The product of the process of claim 2.

9. The product of the process of claim 3.

10. The product of the process of claim 4.

11. The product of the process of claim 5.

12. The product of the process of claim 4.

13. The product of the process of claim 5.

14. The product of the process of claim 6.

15. The method of claim 1 wherein the forming web is kept at a pH of about 6.5 to about 7.0.

16. A method for producing an absorbent cellulosic sheet having a high level of surface-perceived softness that comprises continuously;

a. preparing an aqueous dispersion of cellulosic papermaking fibers, b. forming a web of said cellulosic papermaking fibers substantially free of softener induced deposits, c. dewatering the web to a fiber consistency of about 5% to about 50%, d. adhereing said web to a thermal drying means, e. treating said adhered web with a softener comprising an amido amine having the formula:

$$[(RCO)_2EDA]HX$$

wherein EDA is a diethylenetriamine residue, R is the residue of a fatty acid having from 12 to 22 carbon atoms, and X is an anion wherein the treatment with the amido amine salt is conducted in such a manner that the aqueous phase used in web formation step a) is not contaminated by the amine salt from treatment step e), and f. creping said treated web from said thermal drying means.

17. A method as in claim 16, wherein said salt has the formula $$[(RCONHCH_2CH_2)_2NR']HX$$

wherein R is the residue of a fatty acid having from 12 to 22 carbon atoms, R' is a lower alkyl group, and X is an anion.

18. A method as in claim 16, wherein said salt has the formula $$[(C_{17}H_{33}CONHCH_2CH_2)_2NC_2H_5]HSO_4C_2H_5$$

19. A method as in claim 16 wherein the treatment of said web with said salt results in said salt being distributed substantially equally throughout the entire thickness of said web.

20. The product of the process of claim 16.

21. The product of the process of claim 17.

22. The product of the process of claim 18.

23. A method for producing an absorbent cellulosic sheet having a high level of surface-perceived softness that comprises continuously;

a. preparing an aqueous dispersion of cellulosic papermaking fibers, b. forming a web of said cellulosic papermaking fibers substantially free of softener induced deposits, c. dewatering the web to a fiber consistency of about 5% to about 50%, d. adhering said web to a thermal drying means, e. treating said adhered web with a softener comprising an amido amine salt having the formula $$[(RCO)_2EDA]HX$$

wherein EDA is a diethylenetriamine residue, R is the residue of a fatty acid having from 12 to 22 carbon atoms, and X is an anion with the amido amine salt is conducted in such a manner that the aqueous phase used in web formation step a) is not contaminated by the amine salt from treatment step e), f. drying the web on the thermal drying means to a consistency of at least about 92%, and g. creping said treated web from said thermal drying means.

24. A method as in claim 23, wherein said salt has the formula $$[(RCONHCH_2CH_2)_2NR']HX$$

wherein R is the residue of a fatty acid having from 12 to 22 carbon atoms, R' is a lower alkyl group, and X is an anion.

25. A method as in claim 23, wherein said salt has the formula $$[(C_{17}H_{33}CONHCH_2CH_2)_2NC_2H_5]HSO_4C_2H_5$$

26. A method as in claim 23 wherein the treatment of said web with said salt results in said salt being distributed substantially equally throughout the entire thickness of said web.

27. The product of the process of claim 23.

28. The product of the process of claim 24.

29. The product of the process of claim 25.

* * * * *